United States Patent [19]

Krob et al.

[11] 4,125,275

[45] Nov. 14, 1978

[54] SAFETY SKI BINDING

[75] Inventors: Erwin Krob, Vienna; Josef Svoboda, Schwechat, both of Austria

[73] Assignee: TMC Corporation, Baar, Switzerland

[21] Appl. No.: 829,578

[22] Filed: Aug. 31, 1977

[30] Foreign Application Priority Data

Sep. 2, 1976 [AT] Austria ..... 6497/76

[51] Int. Cl.[2] ..... A63C 9/08

[52] U.S. Cl. ..... 280/626

[58] Field of Search ..... 280/611-637; 36/2.5

[56] References Cited

U.S. PATENT DOCUMENTS

| | | | |
|---|---|---|---|
| 3,492,014 | 1/1970 | Besser | 280/618 |
| 3,521,385 | 7/1970 | Dalebout | 36/2.5 |
| 3,686,778 | 8/1972 | Hornung | 36/2.5 |
| 3,913,930 | 10/1975 | Okonski | 280/637 |

FOREIGN PATENT DOCUMENTS

| | | | |
|---|---|---|---|
| 323,603 | 7/1975 | Austria | 280/611 UX |
| 2,402,974 | 1/1973 | Fed. Rep. of Germany | 280/611 UX |

*Primary Examiner*—Joseph F. Peters, Jr.
*Assistant Examiner*—Gene A. Church
*Attorney, Agent, or Firm*—Blanchard, Flynn, Thiel, Boutell & Tanis

[57] ABSTRACT

A safety ski binding for use with a ski boot having an ankle cuff which is pivotally secured for movement about a transverse axis to the remaining shell portion of the ski boot. The rear side of the ankle cuff of the ski boot has a reinforcing member defining a shoulder or the like. The shoulder of the reinforcing member is engaged by a binding part mounted on the ski binding and has a surface thereon adjustably supported for movement in a vertical direction to control the location of engagement between the shoulder and the surface.

18 Claims, 13 Drawing Figures

SAFETY SKI BINDING

FIELD OF THE INVENTION

The invention relates to a safety ski binding having a reinforcing member for the ski boot having an ankle cuff which is pivotal about a transverse axis and has at least one stiff side portion which gives the ankle cuff of the boot a lateral support, wherein the reinforcing member has a shoulder or the like, which is loaded by a binding part and which forms a removable support, according to U.S. patent application Ser. No. 750,403 filed Dec. 14, 1976, now U.S. Pat. No. 4,093,270.

BACKGROUND OF THE INVENTION

In the construction according to U.S. patent application Ser. No. 750,403, filed Dec. 14, 1976, now U.S. Pat. No. 4,093,270, the upper part of the boot is supported for downhill skiing in a predetermined position or can be released for walking. The present invention has the purpose of facilitating an adjustment of the forward position of the upper part of the ski boot between at least two stepped, preferably several stepped positions and, if desired, a continuous adjustment for the support of the upper part of the boot.

The objects and purposes of the invention are met inventively by the binding part being adjustably arranged in elevational direction on the associated ski binding, in particular on the heel holder, through a bolt or threaded bolt, possibly by the interpositioning of a holding part.

Due to the fact that the binding part is arranged adjustably in elevational direction, it is possible to adjust the forward position of the upper part of the ski boot for the downhill skiing to various angular positions. It would also be conceivable to choose for the walking mode of use a slightly restricting position, if this should be necessary.

Further advantages and details of the invention will be discussed more in detail hereinafter with reference to the drawings, which illustrate several examples.

BRIEF DESCRIPTION OF THE DRAWINGS

In the drawings:

FIGS. 1 and 2 are associated views of a first exemplary embodiment of a heel holder wherein FIG. 1 is a longitudinal cross-sectional view taken along the line I—I of FIG. 2 and wherein FIG. 2 is a top view;

FIGS. 5 and 6 are associated views of a fourth exemplary embodiment wherein FIG. 5 is a planar view, partially in cross section, and FIG. 6 is a top view thereof;

FIGS. 7 to 9 illustrate a fifth exemplary embodiment wherein FIGS. 7 and 8 are similar illustrations to FIGS. 5 and 6, and wherein FIG. 9 is a cross-sectional view taken along the line IX—IX of FIG. 8;

FIGS. 10 and 11 illustrate a sixth exemplary embodiment wherein FIG. 10 is a planar view, partially in cross section, and wherein FIG. 11 is a front view.

DETAILED DESCRIPTION

Figure 1:
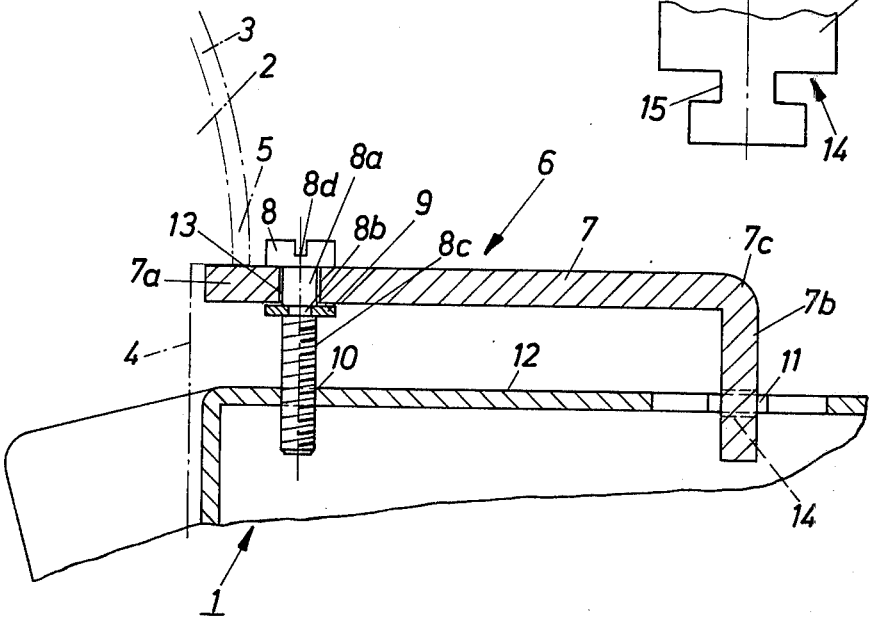

The following description uses, if it does not relate to reoccurring basic parts, for the individual structural parts different reference numerals, even if their function is the same or is similar.

Figure 2:
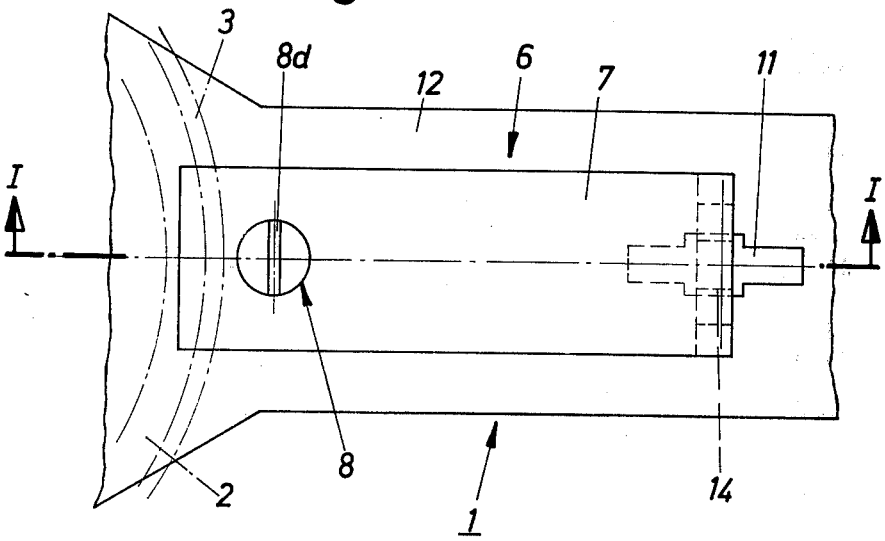

The first exemplary embodiment according to FIGS. 1 and 2 illustrates a heel holder of a ski binding 1 which cooperates with a ski boot 2 which is only schematically indicated. The upper shell part or ankle cuff 3 of the boot projects rearwardly from the heel 4 to define in a shoulder 5 or the like which is supported on a binding part 6 which functions as a support. The ankle cuff 3 is pivoted about a horizontal and laterally extending shaft 3A relative to the lower shell 3B. The binding part 6 is constructed as follows in this exemplary embodiment:

Above the ski binding 1, there is arranged a holding plate 7 which is generally L-shaped in cross section, which holding plate is connected to the ski binding adjacent the ski boot 2 by a threaded bolt 8. The free threaded end of the bolt 8 extends into a threaded hole 10 in the ski binding 1. The end of the holding plate 7 which is remote from the ski boot 2 extends into a recess 11 in the ski binding 1. The threaded hole 10 and the recess 11 are both provided in a housing 12 of the ski binding 1. The threaded bolt 8 has a thread-free neck part 8*a* which is received in a perforation 13 in the holding plate 7. A further necked down portion is provided at 8*b* located below the portion 8*a*. The area 8*c* of the threaded bolt 8 extends below the portion 8*b* and has a thread thereon. A washer 9 is positioned in the necked down portion 8*b* and fixes the position of the threaded bolt 8 in relationship to the holding plate 7. Thus the threaded bolt 8 is rotatably held in a nonaxially movable position by means of the head of the bolt 8 and the washer 9 and is rotated by use of a tool engaging a slot 8*d* in the head.

Figure 1A:
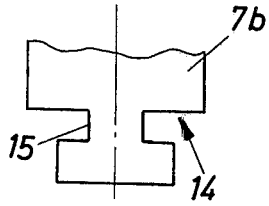
FIG. 1*a* illustrates a detail thereof.

Thus the determination of the desired forward position of the ski boot 2 can be adjusted as needed by operating the threaded bolt 8. This is made possible additionally by the vertically extending leg 7*b* of the holding plate 7 having in the area of the recess 11 of the housing 12 an abutment surface 14. The abutment surface 14 has a cross section illustrated in FIG. 1*a* and can be inserted into the recess 11 of the housing 12 in a position which is 90° offset from the position of use illustrated in FIG. 2. The holding plate 7 can then be swung into the illustrated position of use and can be moved longitudinally of the ski into the desired position of use by inserting the threaded bolt 8 into the threaded hole 10. The necked down part 15 below the abutment surface 14 is larger than the thickness of the housing 12 in this area. This assures that independent from the assumed position of the part of the holding plate 7, which part functions as a support leg 7*a*, said holding plate itself is not exposed to any further bending stress for example in the curved area 7*c*, because the holding plate 7 has in the area of the abutment surface 14 a sufficient clearance. In other words: the abutment surface 14 provides a limited swingable hinge connection.

Figure 3:
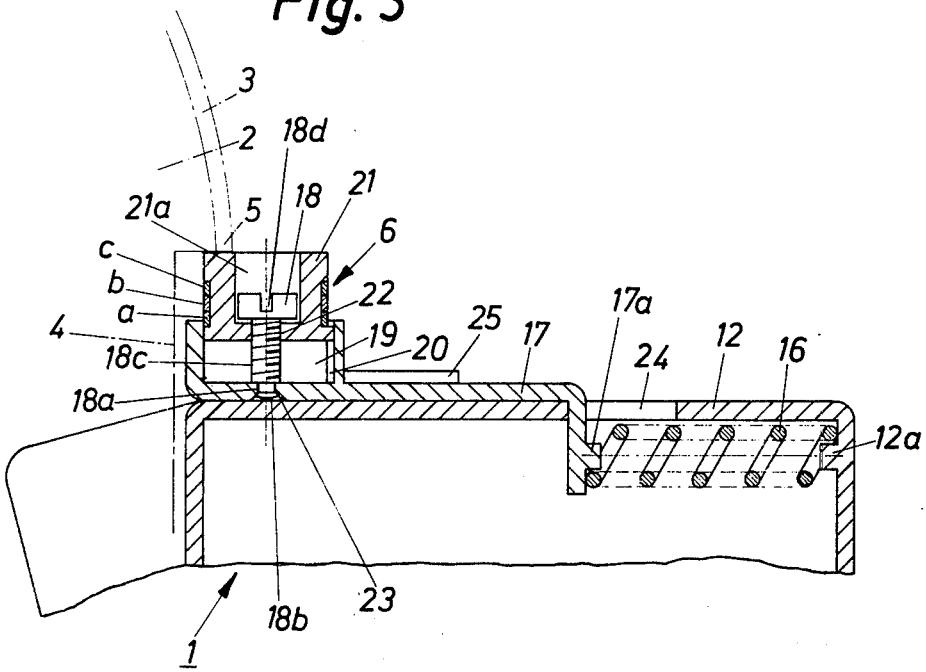
FIGS. 3 and 4 illustrate two further embodiments, respectively similar to the embodiment of FIGS. 1 and 2.

In the second exemplary embodiment according to FIG. 3, the binding part 6 is supported for longitudinal movement and is held against longitudinal movement by the force of a spring 16 in the housing 12 of the ski binding. For this purpose, a slide member 17 is provided which has in its area adjacent the ski boot 2 a receiving portion 19 having a guideway 20 for receiving a vertically adjustable holder 21 therein. For controlling the adjustment in the vertical direction a threaded bolt 18 is provided which, in the present case, is riveted in the slide member 17 and has a thread 18*c* along the entire length of the shaft. The holder 21 has a threaded hole 22 therein which cooperates with the threaded 18*c* of the threaded bolt 18. The thread bolt 18 has at the head part a slot 18*d* which by means of a tool it can be operated. The lower, riveted end of the threaded bolt 18 comprises a thread-free rotatably supported necked down part 18*a* and the riveting 18*b*. An opening 23 is provided in the slide member 17 to receive the necked down part 18*a* and the riveting 18*b*, which opening is enlarged in a downwardly direction. This enlargement permits a riveting of the lower end of the threaded bolt 18 after it has been inserted into the opening 23 of the slide member 17.

A slot 24 is provided in the housing 12 and extends in the longitudinal direction of the ski binding 1. The slot 24 receives and permits an adjustment of the slide member 17 toward and away from the ski boot 2. A spring 16 is engaged with and extends between a leg 12*a* of the housing 12 and the leg 17*a* of the slide member 17. A guideway 25 is provided for laterally supporting the slide member 17 to limit the movement thereof solely to the longitudinal direction. Markings *a, b* and *c* are provided for the easier adjustment of the desired height of the holder 21 and thus of the binding part 6 so that the forward position of the upper part of the ski boot 3 is determined. These markings *a, b* and *c* can be in a conventional manner adjusting rings of different colors, figures or numbers.

The present exemplary embodiment permits both a continuous change of the forward positioning and also a release which can be carried out in a simple manner, such as by moving the slide member 17 against the force of the spring 16. Movement also can be initiated when the ski boot is clamped in, for example, by inserting a ski pole or a suitable ski plate into the recess 21*a* of the holder 21. The resetting is accomplished automatically when the upper part of the ski boot 3 is swung forwardly and the shoulder 5 or the like extends above the support surface of the holder 21. The illustrated position is therewith again attained.

Figure 4:
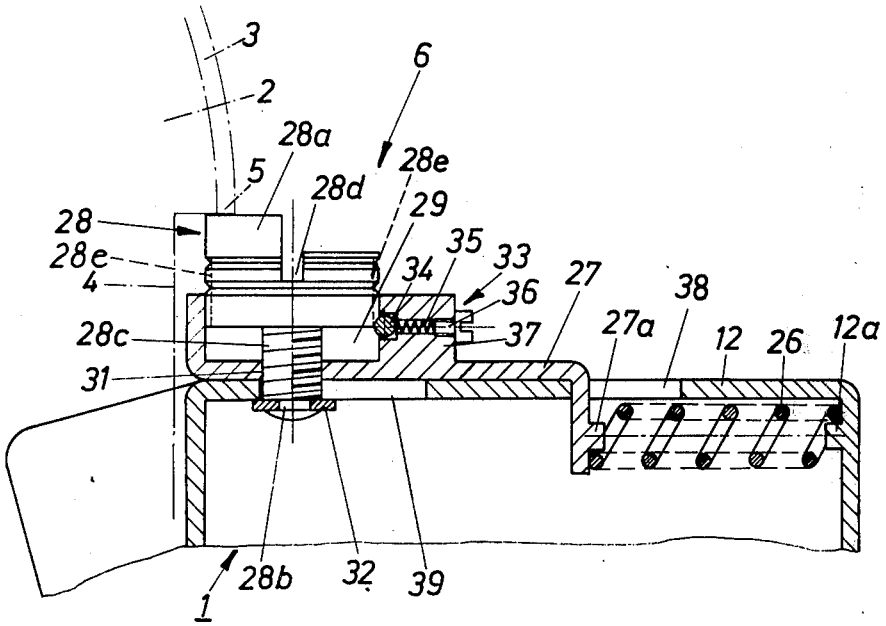

In the exemplary embodiment according to FIG. 4, the longitudinal movability principle shown in FIG. 3 is realized and the threaded bolt 28 is constructed at the same time as a binding part or support member. In the present case, the slide member 27 is again equipped with a receiving portion 29. In this case, a shaft having a thread 28*c* thereon is inserted into a threaded hole 31 in the slide member 27 and is held against an unintended pulling out at the end thereof which projects downwardly through a slot 39 in the housing 12 by means of a washer 32 which is positioned in a necked down part 28*b* on the threaded bolt 28. The washer 32 is riveted to the free lower end of the threaded bolt 28. The head of the threaded bolt 28 has intermediate the height thereof an attachment 28*a*. A tool can engage a slot 28*d* in the head to effect an adjustment thereof. The head of the threaded bolt 28 which can be vertically adjusted in the receiving portion 29 has a plurality of grooves 28*e* therein which extend parallel to the axis thereof and to one another on the peripheral surface thereof and are engaged by a detent 33. The detent 33 consists in detail of a ball 34, a spring 35 and an adjusting screw 36. The detent 33 is housed in a mounting block part 37 on the slide member 27. The bolt 28 has a plurality of annular grooves 28*f* on the periphery thereof so that the position thereof relative to the upper surface of the mounting block part will indicate the adjusted position of the bolt 28. In addition, the grooves 28*e* serve to cooperate with the detent mechanism to lock the bolt 28 in the adjusted position.

Upon adjustment of the head of threaded bolt 28, 180°, a rough adjustment is performed whereas upon operation of the screw thread 31 a fine adjustment is possible. The detent 33 is used to fix the position of the threaded bolt 28 in the desired position. The slide member 27 is moved in the slot 38 of the housing 12 and is adjusted against the force of the spring 26. The shaft 28*c* of the threaded bolt 28 having a thread thereon is received in the slot 39. Further details correspond to the construction according to FIG. 3.

Figure 5:
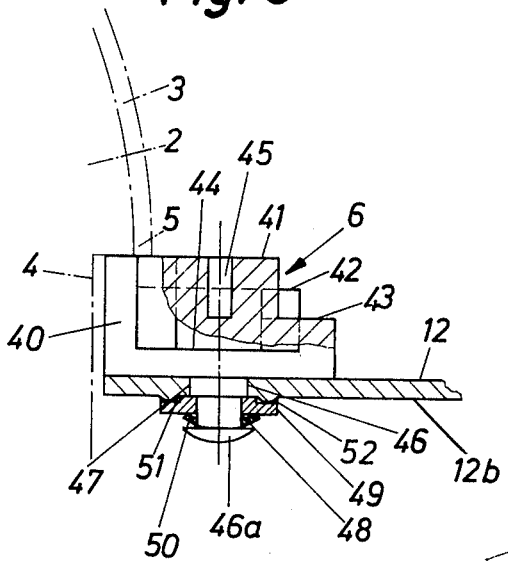
Figure 6:
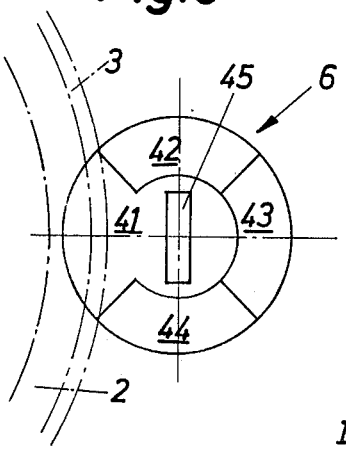

In the embodiment according to FIGS. 5 and 6, the binding part 6 is designed as a multi-stage or multiple stepped bolt 40. The basic parts which are already known from the earlier exemplary embodiments, including the housing 12, are only illustrated to the extent that it is needed for an understanding of this exemplary embodiment. The bolt 40 has four stages or steps 41 to 44 and a rotation of the bolt 40 by use of a tool in the slot 45 will effect a movement of the steps into the area of the shoulder 5 or the like on the boot shell 3. The bolt 40 has a central shaft 46 which extends through an opening 47 provided in the housing 12. The shaft 46 also has a necked down part 48 which receives a washer 49 therein. A spring plate 50 is positioned between the washer 49 and the riveted free end 46*a* to urge the washer against the lower side 12*b* of the housing 12 as well as the head of the bolt 40 against the upper surface of the housing 12. In order to assure that the desired and adjusted position of the bolt 40 will be maintained and will be able to carry out at the same time a rotation without overcoming too great a friction, the washer 49 has on the side facing the housing 12 a plurality of recesses 51 and the associated area of the housing 12 has a plurality of detents 52. By engaging the detents 52 with the provided recesses 51 at a correct positioning of the bolt 40, a secure holding of the bolt 40 is assured. If, however, a rotation of the bolt 40 takes place, which is carried out for example by inserting a coin, a screw driver or the like into the slot 45, then the surface having the recesses 51 therein will slide relative to the detents 52 so that only a small frictional resistance exists between the surface and the detents.

The illustrated exemplary embodiment has four different elevational positions. It is easily conceivable to use several steps, or to arrange, for a full release, the bolt 40 on a slide member, as is used in FIGS. 3 or 4. In this case, the release may be lower than is determined by the existing step 44.

Figure 9:
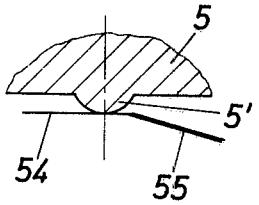
Figure 7:
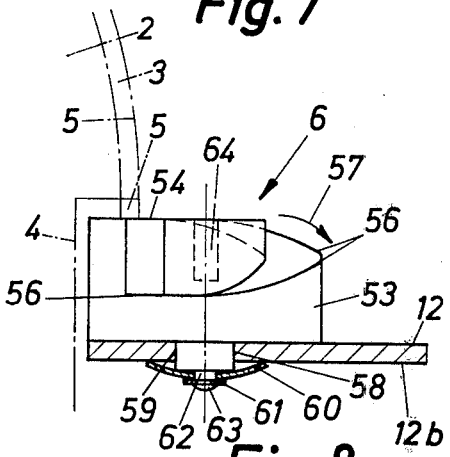
Figure 8:
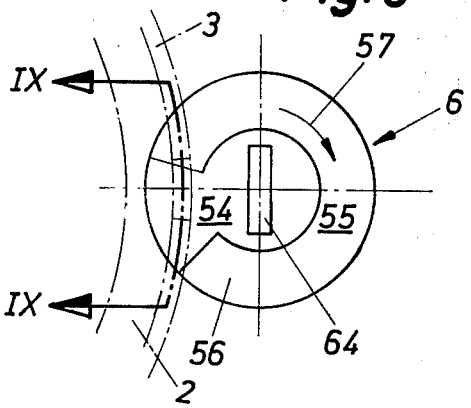

The exemplary embodiment illustrated in FIGS. 7 to 9 uses a similar basic concept as that used and disclosed in the exemplary embodiment illustrated in FIGS. 5 and 6 except that between the precisely determined uppermost and lowermost steps, a continuous curved or dished surface is provided and, therefore, a continuous adjustment of the height or the forward position of the boot shaft can be achieved as opposed to a stepped adjustment. Known parts have been listed also only as needed in this exemplary embodiment.

The bolt 53 has an uppermost step 54 and a downwardly inclined path 55 which starts out from the uppermost step 54 and slopes downwardly in direction of the lowermost step 56. The downwardly inclined direction of the path 55 is indicated by the arrow 57 in FIG.

8. The bolt 53 has a necked down part 58 which extends through an opening 59 in the housing 12 and has on the lower side 12*b* of the housing a washer 61 received in a further necked down part 62. A spring 60 is positioned between the washer 61 and the underside 12*b* of the housing 12. The washer 61 is held to the bolt 53 by a rivet 63 which is provided at the free lower end of the neck 58. The bolt 53 can be rotated by means of a tool received in a slot 64 in the upper surface 54. Due to the fact that the bolt 53 is supported by means of a spring 60, both the adjustment into the desired position and also a maintaining of the bolt 53 in the adjusted position is assured.

In order to facilitate a secure engagement between the shoulder 5 or the like and the steps 54 and 56 and the path 55, the shoulder 5 or the like has in the contact area a support surface 5' which is approximately semicircular in cross section. For a better illustration, an enlarged cross section of this construction is illustrated in FIG. 9 with the uppermost step 54 and the path 55.

Figure 10:
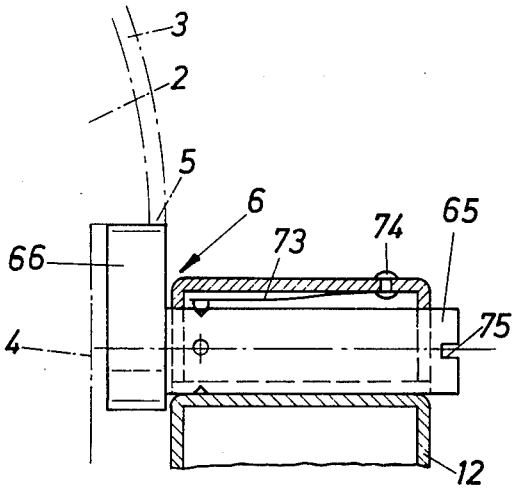
Figure 11:
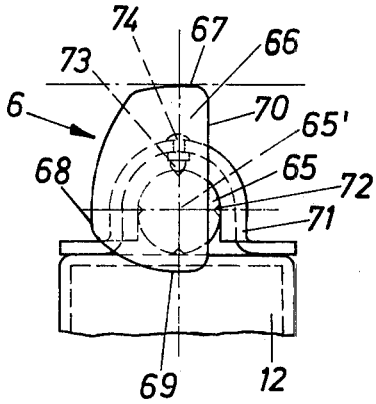
Figure 12:
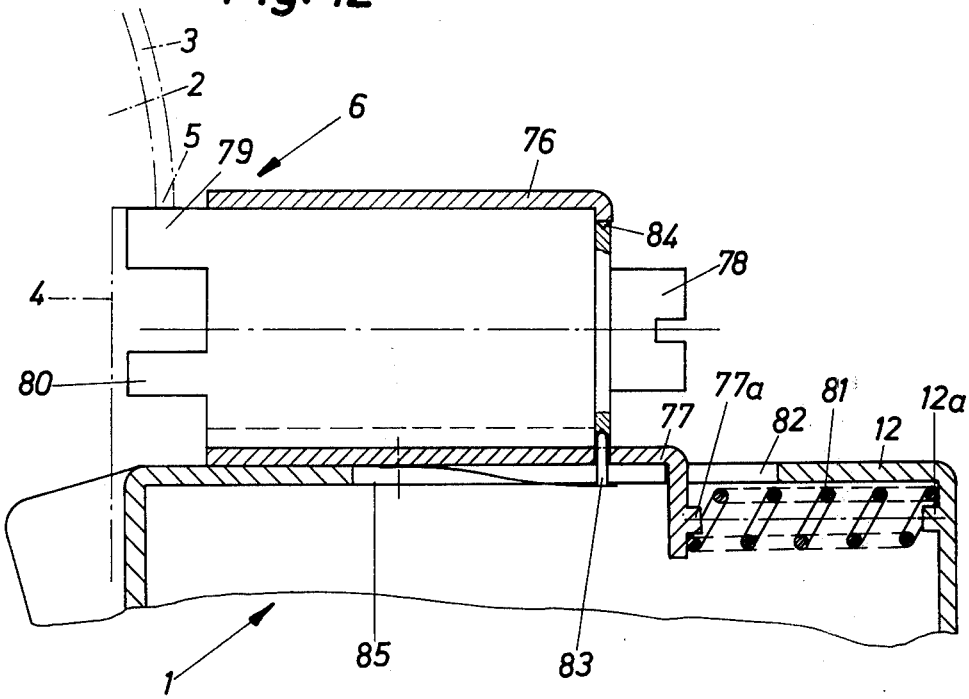
FIG. 12 is a planar view in cross section of a seventh exemplary embodiment.

Further exemplary embodiments are illustrated in FIGS. 10 to 12 and in both cases the bolt is horizontally oriented and the support therefor is done by means of eccentrically arranged surfaces which by rotation of the associated bolt are moved into the respectively desired position.

In the exemplary embodiment according to FIGS. 10 and 11, the binding part 6 has an eccentric 66 which is positioned on the end of the bolt 65 and which has four support surfaces 67 to 70 which lie at different distances from the axis 65' thereof. The bolt 65 is rotatably supported in a bearing 71 which is arranged on the housing 12 and is secured to the housing by not illustrated screws. For the purpose of fixing the position of the eccentric 66 in the respective adjusted positions, dimples 72 are provided on the periphery of the bolt 65, which dimples receive a resilient locking pin 73. The locking pin 73 is secured to the bearing 71 by means of a rivet 74. The dimples 72 are arranged such that they are in alignment with tangential lines generated by supporting the shoulder 5 or the like of the upper part of the ski boot 3 on one of the support surfaces 67 to 70. It is easily conceivable to choose the design of the support surfaces 67 to 70 such that between the shoulder 5 or the like and the support surfaces 67 to 70, a further support surface is provided.

There is no need to discuss in detail that the bolt 65 can be rotated by inserting a suitable tool or a coin into the slot 75 so that the eccentric 66 can be moved into the desired position. Of course, in this construction the release position which follows a rearward shifting of the upper part of the ski boot 3 is determined by the height of the lowermost support surface 70, which lies at any rate above the housing 12, because the bolt 65 is stored only in this area.

To set up a release up to the upper side of the ski binding 1, the construction according to FIG. 12 is used. In this case — similar to the exemplary embodiments according to FIG. 3 or 4 — a slide member 77 is provided and on which the bolt 78 is rotatably mounted in a bearing 76. In this case, two steps 79 and 80 are provided and are worked out of the material of the bolt 78. However, it is easily conceivable to also use several steps. A release takes place against the force of the spring 81 arranged between the legs 12*a* and 77*a* of the housing 12 and the slide member 77, respectively. To facilitate shifting of the slide member 77, a slot 82 is provided in the housing 12. For the purpose of securing the bolt 78 in the predetermined position, a resilient locking pin is secured on the slide member 77 and in the associated peripheral range of the bolt 78 there are provided corresponding dimples 84. A suitable recess 85 is provided in the housing 12 for receiving the locking pin 83 therein. The operation and action corresponds with the earlier description.

The invention is not limited to the listed examples. As already indicated, further variations and combinations are possible without departing from the scope of the invention. However, it is important to the invention that beyond the solution listed in the aforementioned patent application Ser. No. 750,403, the support is available in at least two different positions.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a combination of a ski boot and a ski binding, said ski boot having a lower shell and an ankle cuff pivotally secured to said lower shell to allow pivotal movement of said ankle cuff about a pivot axis in response to shifts in the weight of an individual using said ski boot, said ski binding including at least a heel holder engaging the heel portion of said ski boot to hold said heel portion to a ski, said ankle cuff having projection means extending rearwardly therefrom and includes first means thereon defining a downwardly facing first surface, said heel holder including second means defining an upwardly facing second surface, said first surface directly engaging said second surface to limit the amount of pivotal movement of said ankle cuff to the rear of said lower shell, the improvement comprising adjustment means operatively connecting said second means to said heel holder for adjustably supporting said second means to effect a varying of the vertical height of said second surface relative to said ski boot.

2. The improved combination according to claim 1, wherein said second means includes a holding part;

wherein said adjustment means includes a threaded bolt supported solely for rotation on and with respect to said holding part;

wherein said heel holder has third means defining a threaded hole therein threadedly receiving said threaded bolt therein; and wherein said holding part is generally L-shaped having two generally perpendicularly related legs, said threaded bolt being mounted on one leg, said other leg being connected to said heel holder, said one leg being vertically spaced above said heel holder.

3. The improved combination according to claim 2, wherein said other leg of said holding part is releasably connected to said heel holder, said heel holder having an elongate slot therein, said other leg having an abutment surface receivable in said slot and rotated through 90° to effectively connect said other leg to said heel holder.

4. The improved combination according to claim 1, wherein said second means includes a slide member slidably supported on said heel holder in a direction parallel to the longitudinal axis of said ski;

wherein said adjustment means includes a threaded bolt arranged on said slide member, a spring for resisting the sliding movement of said slide member away from said ski boot, and wherein on said slide member there is provided a receiving portion with a guideway and a holder, said holder being operatively connected to said guideway and supported for vertical movement, wherein said holder has a threaded hole therein in which is threadedly received said threaded bolt, and wherein said threaded bolt is rotatably connected to said slide member and facilitating a vertical adjustment of said holder in response to a rotation of said threaded bolt.

5. The improved combination according to claim 4, wherein said holder has markings (*a, b, c*) on its outer surface, which markings indicate the adjusted elevational position.

6. The improved combination according to claim 1, wherein said second means includes a slide member slidably supported on said heel holder in a direction parallel to the longitudinal axis of said ski, said slide member having a threaded hole therein;

wherein said adjustment means includes a threaded bolt having a threaded shaft received into said threaded hole, a spring for resisting the sliding movement of said slide member away from said ski boot, said heel holder having an elongate slot therein extending in a direction parallel to the longitudinal axis of said ski, said threaded bolt extending through said slot, a washer secured to said threaded bolt adjacent one end thereon, wherein on said slide member there is provided a receiving portion with a guideway and a holder, said holder being connected to the other end of said threaded bolt and being rotatable therewith, and wherein said second surface is provided on said holder and is divided into plural surface segments of differing elevations whereby a rotation of said holder presents selected surface segments beneath said first surface and detent means for releasably holding said holder in a selected position.

7. The improved combination according to claim 6, wherein said detent means is arranged in said receiving portion of said slide member and has a locking element, a spring and an adjusting screw, the degree of compression of said spring between said locking element and said adjusting screw being controlled by the position of said adjusting screw relative to said locking element.

8. The improved combination according to claim 1, wherein said second means includes a holder having said second surface thereon, said second surface including plural surface segments of differing elevation, said adjustment means supporting said holder for rotation to present a selected surface segment beneath said first surface.

9. The improved combination according to claim 8, wherein said adjustment means includes a bolt secured to said holder and rotatable therewith, said bolt extending through an opening in said heel holder, a washer and a plate spring secured to said bolt between the end thereof and a surface on said heel holder to facilitate said holder to move slightly along the axis of said bolt against the resistance of said spring plate, said washer and said surface on said heel holder having detent means therebetween releasable in response to a movement of said holder for locking said holder in selected position.

10. The improved combination according to claim 9, wherein said detent means includes on said washer on its side which faces said surface a recess which operatively receives therein locking and running elements of the associated area on said surface, which locking and running elements are constructed as detents.

11. The improved combination according to claim 8, wherein said surface segments include at least an uppermost and a lowermost step and wherein between the uppermost step and the lowermost step there is provided a continuous and smooth pathway which forms a continuously decreasing connection from said uppermost step to said lowermost step.

12. The improved combination according to claim 11, wherein said adjustment means includes a bolt having a smaller diameter portion which extends downwardly through an opening in a surface of said heel holder to the lower side thereof and a spring for urging said holder into engagement with said surface, said spring being positioned between said heel holder and a free end of said bolt.

13. The improved combination according to claim 8, wherein said first surface includes in its area which faces said second surface a support surface which in cross section is generally semicircularly shaped, which support surface rests in each position of said holder on said second surface.

14. The improved combination according to claim 1, wherein said adjustment means includes a horizontally oriented bolt extending substantially parallel to the longitudinal axis of said ski and above said heel holder and bearing means supporting said bolt for rotation, said bolt having said second surface thereon which includes at least two support surfaces which extend eccentrically with respect to one another in relationship of the axis of said bolt, and detent means for fixedly locating said bolt and to simultaneously align one of said support surfaces beneath said first surface.

15. The improved combination according to claim 14, wherein said eccentric surfaces includes four support surfaces spaced from the axis of said bolt with different eccentricity with one of the support surfaces being free of engagement with said first surface.

16. The improved combination according to claim 14, wherein said detent means includes dimples on the outer surface of said bolt and a resilient locking pin operatively received therein.

17. The improved combination according to claim 14, wherein said support surfaces are constructed of the material of said bolt.

18. The improved combination according to claim 17, wherein said detent means includes a locking pin positioned in the area of said bearing means and dimples on the periphery of a collar of said bolt.

* * * * *